US011721253B2

(12) United States Patent
Aogaki et al.

(10) Patent No.: US 11,721,253 B2
(45) Date of Patent: Aug. 8, 2023

(54) DEMURA PROCESSING FOR A DISPLAY PANEL HAVING MULTIPLE REGIONS WITH DIFFERENT PIXEL DENSITIES

(71) Applicant: Synaptics Incorporated, San Jose, CA (US)

(72) Inventors: Kazutoshi Aogaki, Kanagawa (JP); Hirobumi Furihata, Tokyo (JP); Takashi Nose, Kanagawa (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 17/896,910

(22) Filed: Aug. 26, 2022

(65) Prior Publication Data

US 2023/0120671 A1 Apr. 20, 2023

Related U.S. Application Data

(60) Provisional application No. 63/257,549, filed on Oct. 19, 2021.

(51) Int. Cl.
*G09G 3/20* (2006.01)
*G09G 3/00* (2006.01)

(52) U.S. Cl.
CPC ..... *G09G 3/006* (2013.01); *G09G 2320/0233* (2013.01); *G09G 2320/0285* (2013.01)

(58) Field of Classification Search
CPC ..... G09G 3/006; G09G 2320/0233; G09G 2320/0285; G09G 3/20; G09G 2340/0407
See application file for complete search history.

(56) References Cited

U.S. PATENT DOCUMENTS

| | | | | |
|---|---|---|---|---|
| 10,733,958 | B1 * | 8/2020 | Kuo | G09G 5/06 |
| 11,315,525 | B1 * | 4/2022 | Hong | G09G 5/10 |
| 11,386,832 | B1 * | 7/2022 | Yoo | G09G 3/2096 |
| 2019/0371219 | A1 * | 12/2019 | Lin | G09G 3/03 |
| 2020/0013348 | A1 * | 1/2020 | Lee | G09G 3/3406 |
| 2020/0035152 | A1 * | 1/2020 | Zhang | G09G 3/3225 |
| 2020/0090565 | A1 * | 3/2020 | Sawahata | G09G 3/006 |
| 2020/0168167 | A1 * | 5/2020 | Tsai | G09G 3/3208 |
| 2020/0234634 | A1 * | 7/2020 | Li | G09G 3/3208 |
| 2020/0294469 | A1 * | 9/2020 | Kim | G09G 5/00 |

(Continued)

FOREIGN PATENT DOCUMENTS

CN 109300444 B * 1/2020 ..... G09G 3/3607

*Primary Examiner* — Jose R Soto Lopez
(74) *Attorney, Agent, or Firm* — Ferguson Braswell Fraser Kubasta PC

(57) ABSTRACT

A method includes generating first demura data comprising first correction amounts for pixels in a first region of a display panel. The first region has a first pixel density. The method further includes generating second demura data comprising second correction amounts for pixels in a second region of the display panel. The second region has a second pixel density different from the first pixel density. The method further includes generating modified second demura data by modifying the second correction amounts by a first factor. The method further comprises compressing the first demura data and the modified second demura data to generate compressed demura data. The method further includes providing the compressed demura data and factor information indicative of the first factor to a display driver.

18 Claims, 6 Drawing Sheets

(56) References Cited

U.S. PATENT DOCUMENTS

| | | | | |
|---|---|---|---|---|
| 2021/0049950 | A1* | 2/2021 | Bae | G06T 5/002 |
| 2021/0065625 | A1* | 3/2021 | Wang | G09G 3/3233 |
| 2021/0065641 | A1* | 3/2021 | He | G09G 3/3655 |
| 2021/0335223 | A1* | 10/2021 | Shen | G09G 5/10 |
| 2021/0358379 | A1* | 11/2021 | Li | G09G 3/2074 |
| 2022/0059011 | A1* | 2/2022 | Li | G07F 17/3213 |
| 2022/0165201 | A1* | 5/2022 | Park | G09G 3/006 |
| 2022/0165220 | A1* | 5/2022 | Kim | G09G 5/10 |
| 2022/0190299 | A1* | 6/2022 | Zheng | H10K 50/86 |
| 2022/0246108 | A1* | 8/2022 | Park | G09G 3/3225 |
| 2022/0335876 | A1* | 10/2022 | Chen | G09G 3/2074 |
| 2022/0343845 | A1* | 10/2022 | Wu | G09G 3/3233 |

* cited by examiner

DEMURA PROCESSING FOR A DISPLAY PANEL HAVING MULTIPLE REGIONS WITH DIFFERENT PIXEL DENSITIES

CROSS-REFERENCE TO RELATED APPLICATIONS

This application claims priority under 35 U.S.C. § 119(e) to U.S. Provisional patent application Ser. No. 63/257,549, filed on Oct. 19, 2021 and entitled, "DEMURA PROCESSING FOR A DISPLAY PANEL HAVING MULTIPLE REGIONS WITH DIFFERENT PIXEL DENSITIES", which is incorporated herein by reference in its entirety.

FIELD

The disclosed technology generally relates to demura processing for a display panel having multiple regions with different pixel densities.

BACKGROUND

Display panels such as organic light emitting diode (OLED) display panels and liquid crystal display (LCD) panels may experience variations in pixel characteristics resulting from the manufacturing process. Variations in the pixel characteristics may cause non-uniform brightness in a displayed image, which is often referred to as "mura" effect. The mura effect may undesirably deteriorate the image quality of a displayed image. To mitigate the mura effect, a display driver may be configured to apply demura processing (also referred to as mura correction or mura compensation) to image data to correct or compensate "mura" in the displayed image.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In general, in one aspect, a method for demura processing includes generating first demura data that includes first correction amounts for pixels in a first region of a display panel. The first region has a first pixel density. The method further includes generating second demura data that includes second correction amounts for pixels in a second region of the display panel. The second region has a second pixel density different from the first pixel density. The method further includes generating modified second demura data by modifying the second correction amounts by a first factor. The method further comprises compressing the first demura data and the modified second demura data to generate compressed demura data. The method further includes providing the compressed demura data and factor information indicative of the first factor to a display driver.

In general, in one aspect, a calibration device includes a processing unit and interface circuitry. The processing unit is configured to generate first demura data that includes first correction amounts for pixels in a first region of a display panel. The first region has a first pixel density. The processing unit is further configured to generate second demura data that includes second correction amounts for pixels in a second region of the display panel. The second region has a second pixel density different from the first pixel density. The processing unit is further configured to generate modified second demura data by modifying the second correction amounts by a first factor. The processing unit is further configured to compress the first demura data and the modified second demura data to generate compressed demura data. The interface circuitry is configured to provide the compressed demura data and factor information indicative of the first factor to a display driver.

In general, in one aspect, a display driver includes decompression circuitry, modification circuitry, and image processing circuitry. The decompression circuitry is configured to decompress compressed demura data to generate first decompressed demura data for a first region of a display panel and second decompressed demura data for a second region of the display panel. The first region has a first pixel density and the second region has a second pixel density different from the first pixel density. The modification circuitry is configured to generate modified second decompressed demura data by modifying correction amounts of the second decompressed demura data by a second factor. The image processing circuitry is configured to perform demura processing using the first decompressed demura data and the modified second decompressed demura data.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
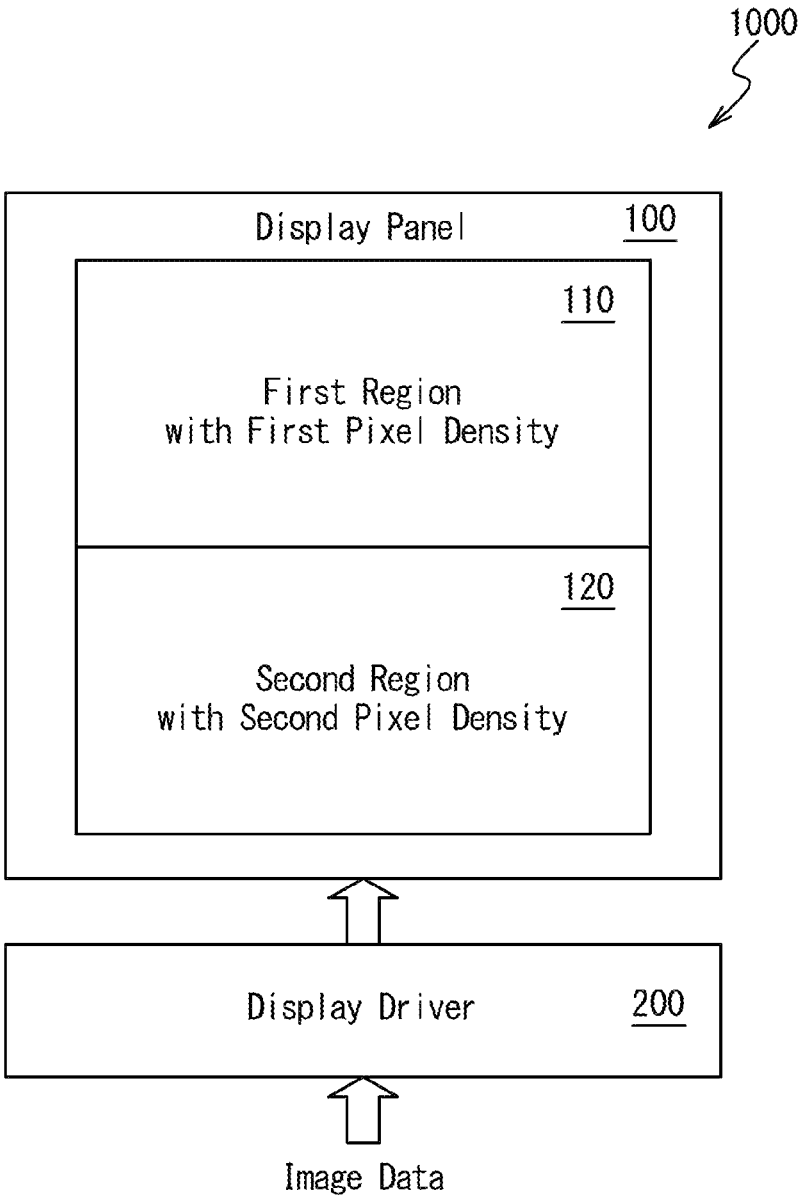
FIG. 1 illustrates an example configuration of a display module, according to one or more embodiments.

To facilitate understanding, identical reference numerals have been used, where possible, to designate identical elements that are common to the figures. It is contemplated that elements disclosed in one embodiment may be beneficially utilized in other embodiments without specific recitation. Suffixes may be attached to reference numerals for distinguishing identical elements from each other. The drawings referred to herein should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature, and is not intended to limit the disclosed technology or the application and uses of the disclosed technology. Furthermore, there is no intention to be bound by any expressed or implied theory presented in the preceding technical field, background, or the following detailed description.

In the following detailed description of embodiments, numerous specific details are set forth in order to provide a more thorough understanding of the disclosed technology. However, it will be apparent to one of ordinary skill in the art that the disclosed technology may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

A display panel as manufactured may suffer from a "mura" effect in which undesired non-uniform brightness appears on the display panel. Since the manufacturing process is not completely uniform over the display panel, pixel characteristics may vary depending on the positions in the display panel. The manufacturing process variations in the pixel characteristics may cause the mura effect.

One approach to mitigate the mura effect is demura processing that modifies image data in accordance with demura data (which may be also referred to as demura table). The demura data may include correction amounts for respective pixels of a display panel and the demura processing may modify the image data in accordance with the correction amounts. The demura data may be generated based on mura information of the display panel. In one implementation, the mura information may be generated based on measured luminance values of respective pixels of the display panel for one or more test images.

The recent increase in resolutions of display panels may cause an increase in the size of the demura data, necessitating provision of a large-sized storage to store the demura data. To address the increase in the demura data size, the demura data may be compressed and stored in a storage in the compressed form. When applying the demura processing, the compressed demura data are decompressed to reproduce the correction amounts, and the reproduced correction amounts are applied to the image data. To improve the compression ratio, a lossy compression algorithm may be used to compress the demura data.

Some display panels may include multiple regions with different pixel densities. One example is a display panel adapted to an under display camera (UDC) technology. A display panel adapted to the UDC technology may include a UDC region under which a camera is disposed. The pixel density of the UDC region may be lower than the pixel density of the remaining region of the display panel. The UDC region thus configured has a higher transparency than the remaining region, allowing the camera to capture an image through the UDC region with reduced disturbance.

To display a continuous image over the entire display panel having multiple regions with different pixel densities, pixels in the respective regions may be operated to emit light with different luminance. Depending on the pixel density, the luminance may be different even if the graylevel for the regions are the same. For a display panel including a UDC region, for example, pixels in the UDC region may be operated to emit light with a higher luminance than the luminance of pixels in the remaining region for the same graylevel. In implementations where the pixel density of the UDC region is one M-th (1/M) of the pixel density of the remaining region, for example, the pixels in the UDC region may be operated to emit light with M times the luminance of the pixels in the remaining region for the same graylevel.

The correction amounts to be applied to image data in the demura processing depend on the pixel density. This is because the correction amounts depend on the luminance of the pixels, and the luminance of the pixels are affected by the pixel density. For example, the correction amounts for the pixels in the UDC region may be generally larger than the correction amounts for the pixels in the remaining region.

The present disclosure recognizes that compression efficiency and/or compression quality of demura data can be improved by using the relationship between pixel densities and the correction amounts. In some embodiments, some of the correction amounts of demura data are modified before compressing the demura data to reduce the variations in the correction amounts. In one implementation, some of the correction amounts of demura data can be multiplied by a factor before compressing the demura data. The factor may be based on the pixel densities of the respective regions. The demura data is then compressed to generate compressed demura data. By modifying (e.g., multiplying) some of the correction amounts, variations in the correction amounts of the demura data to be compressed can be reduced. The reduction in the variations in the correction amounts may effectively improve the compression efficiency and/or compression quality in generating the compressed demura data. When demura processing is applied to image data, the compressed demura data is decompressed and correction amounts are reproduced by modifying the corresponding correction amounts of the decompressed demura data by a second factor determined based on the first factor. In one implementation, the original correction amounts are reproduced by multiplying the corresponding correction amounts of the decompressed demura data by a second factor determined based on the first factor. The second factor may be a reciprocal of the first factor. In other embodiments, the second factor may be a value close to the reciprocal of the first factor. In the following, a detailed description is given of embodiments of the present disclosure.

FIG. 1 illustrates an example configuration of a display module 1000, according to one or more embodiments. In the illustrated embodiment, the display module 1000 includes a display panel 100 and a display driver 200. The display driver 200 is configured to drive the display panel 100. The display panel 100 may be an organic light emitting diode (OLED) display panel, a liquid crystal display (LCD) panel, or a display panel implementing various other suitable display technologies.

In the illustrated embodiment, the display panel 100 includes a first region 110 with a first pixel density and a second region 120 with a second pixel density different from the first pixel density. Although FIG. 1 illustrates that the first region 110 and the second region 120 are defined as rectangular regions and arrayed in the vertical direction of the display panel 100, the shapes, locations, and arrangements of the first region 110 and the second region 120 may be variously modified in accordance with the use of the display module 1000.

Figure 2:
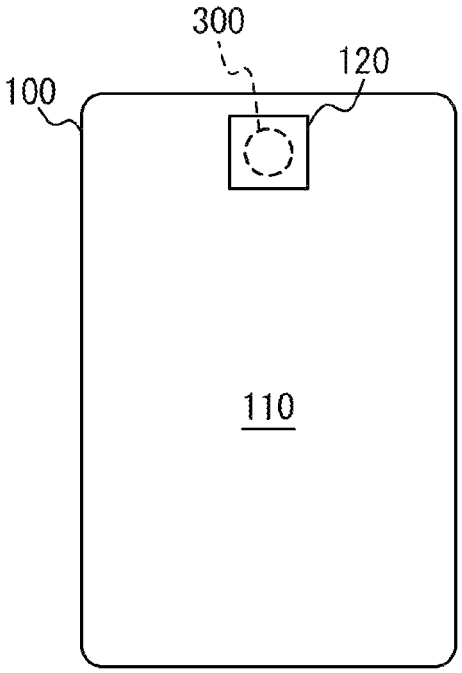
FIG. 2 illustrates an example configuration of a display panel, according to one or more embodiments.

FIG. 2 illustrates an example configuration of the display panel 100, according to one or more embodiments. In the illustrated embodiment, the second region 120 is a rectangular region surround by the first region 110. In the illustrated embodiment, the second region 120 is used as a UDC region under which a camera 300 is disposed. In embodiments where the second region 120 is used as the UDC region, the pixel density of the second region 120 is lower than the pixel density of the first region 110 to allow the camera 300 to capture an image through the UDC region with reduced disturbance.

Figure 3:
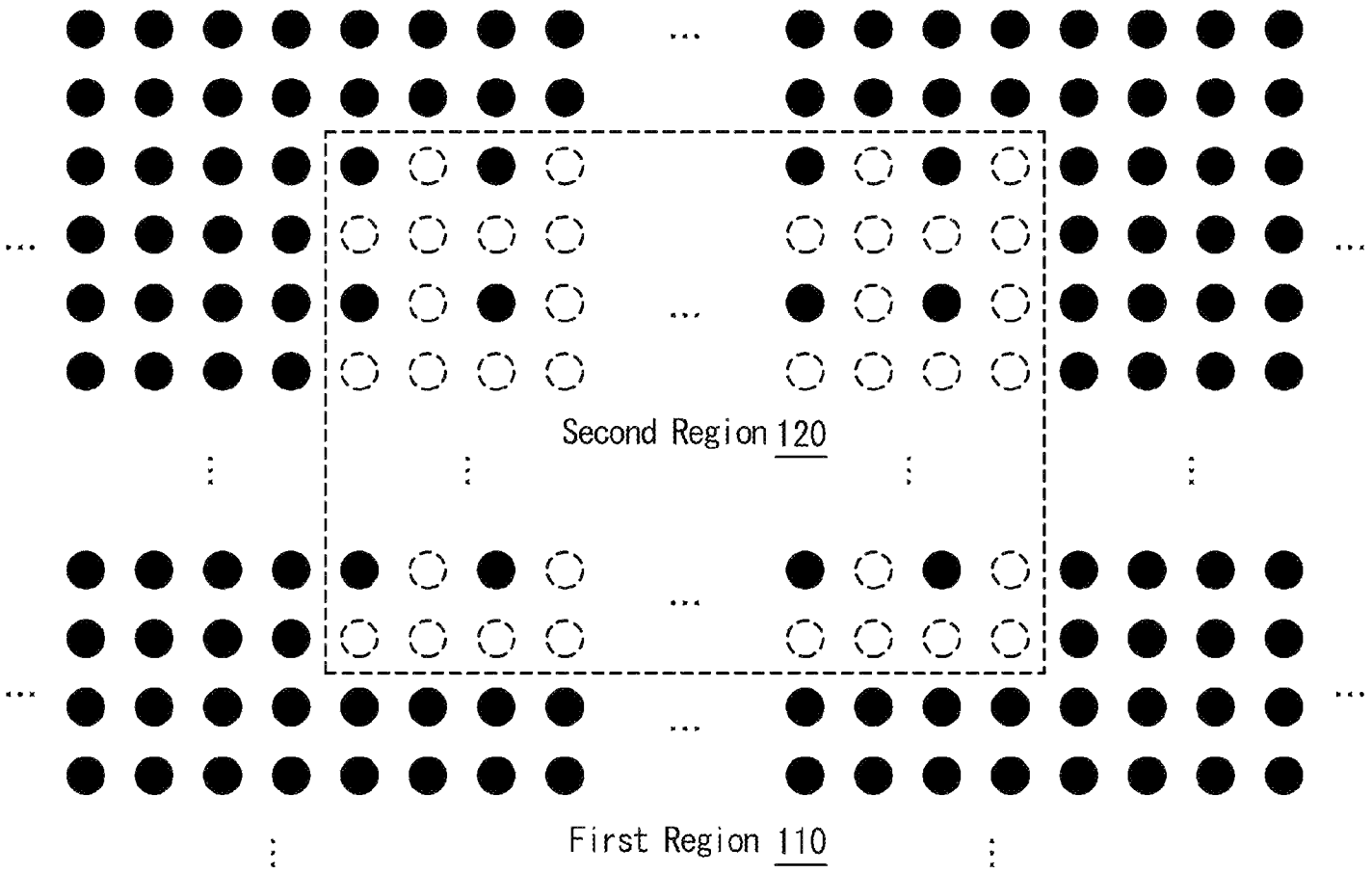
FIG. 3 illustrates example pixel arrangements of first and second regions of a display panel, according to one or more embodiments.

FIG. 3 illustrates example pixel arrangements of the first region 110 and the second region 120, according to one or more embodiments. In FIG. 3, the solid circles indicate pixels. In the illustrated embodiment, pixels are "thinned out" in the second region 120 and therefore the pixel density of the second region 120 is lower than the pixel density of the first region 110. The dashed circles indicate absence of pixels. In the embodiment illustrated in FIG. 3, the pixel density of the second region 120 is one fourth of the pixel density of the first region 110. The ratio of the pixel density of the second region 120 to the pixel density of the first region 110 may be different from one fourth.

When a continuous image is displayed over the entire display panel 100, including the first region 110 and the second region 120, pixels in the second region 120 are operated to emit light with a higher luminance than the luminance of pixels in the first region 110 for the same graylevel. In implementations where the pixel density of the second region 120 is one M-th of the pixel density of the first region 110, for example, the pixels in the second region 120 may be operated to emit light with M times as high as the luminance of the pixels in the first region 110 for the same graylevel, where M is more than one.

Figure 4:
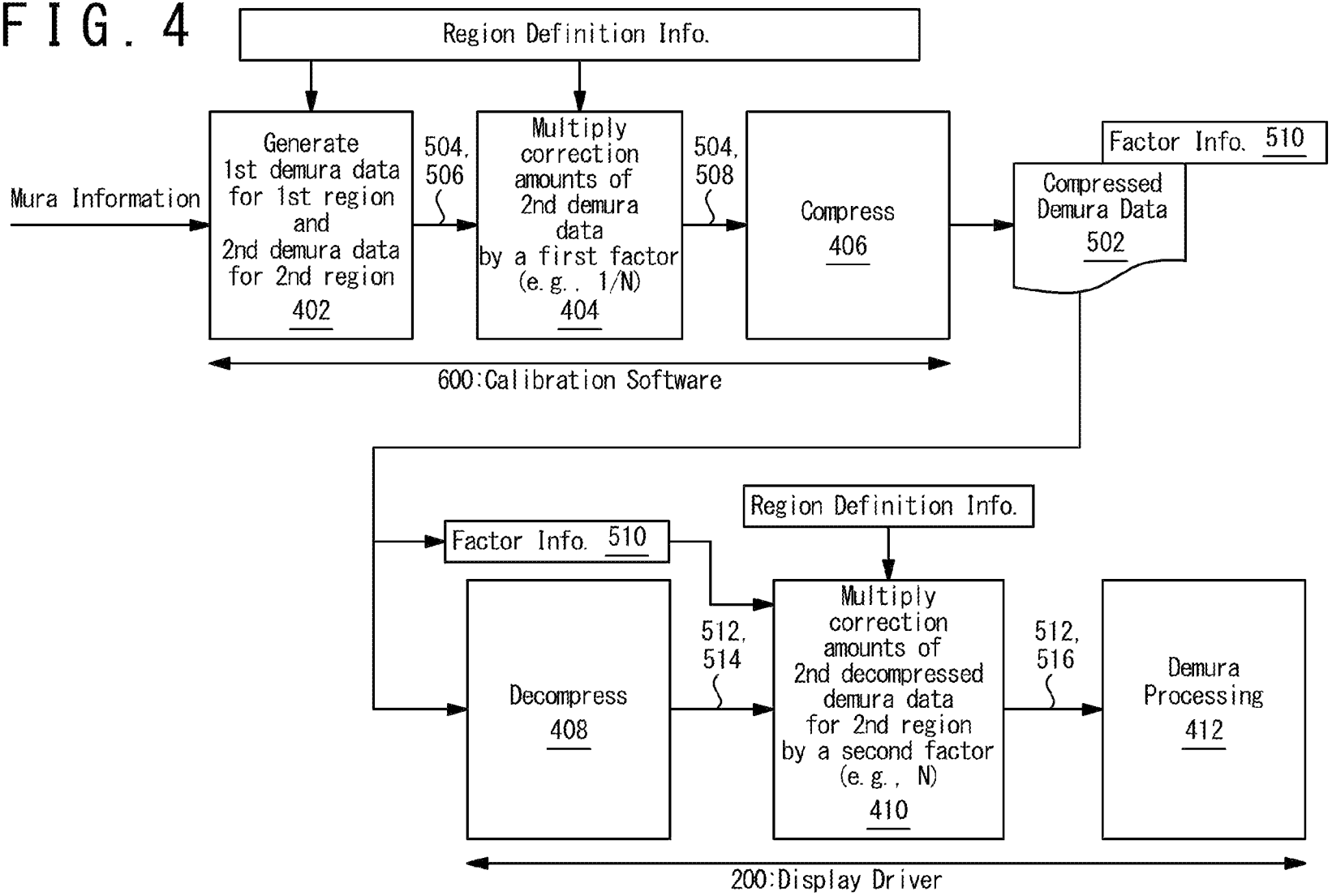
FIG. 4 illustrates an example demura method for a display module, according to one or more embodiments.

FIG. 4 illustrates an example demura method for the display module 1000 described in relation to FIGS. 1 to 3, according to one or more embodiments. In the illustrated embodiment, compressed demura data 502 is generated in a calibration process of the display module 1000 by calibration software 600 executed on a calibration device. The calibration process may be implemented during a pre-shipment test.

At step 402, the calibration software 600 generates first demura data 504 for the first region 110 and second demura data 506 for the second region 120 based on mura information of the display panel 100. In one implementation, region definition information is provided to the calibration software 600 to indicate the definitions of the first region 110 and the second region 120 at step 402. The mura information may include deviations of measured luminance values of the pixels in the display panel 100 from a reference luminance value for one or more test images. The first demura data 504 includes correction amounts for the pixels in the first region 110, and the second demura data 506 includes correction amounts for the pixels in the second region 120.

At step 404, the calibration software 600 generates modified second demura data 508 by modifying the correction amounts of the second demura data 506 by a first factor. In one or more embodiment, the modifying is achieved by multiplying the correction amounts of the second demura data 506 by the first factor. The first factor may be determined such that data value variations in the entire demura data consisting of the first demura data 504 and the modified second demura data 508 are smaller than data value variations in the entire demura data consisting of the first demura data 504 and the second demura data 506 before the modifying (i.e., the original second demura data 506). The data value variations in the entire demura data may be measured as the dispersion (e.g., average deviation, variance, and standard deviation) of the data values (i.e., the correction amounts) of the entire demura data.

In some embodiments, the calibration software 600 may determine the first factor based on the ratio between the average of the correction amounts for the pixels in the first region 110 and the average of the correction amounts for the pixels in the second region 120 before the modifying. In one implementation, the first factor may be 1/N, where N is a value determined based on the ratio between the average of the correction amounts for the pixels in the first region 110 and the average of the correction amounts for the pixels in the second region 120 before the modifying. In embodiments where the average of the correction amounts for the pixels in the first region 110 is $C_{ave1}$ and the average of the correction amounts for the pixels in the second region 120 before the modifying is $C_{ave2}$, N may be $C_{ave2}/C_{ave1}$. In such embodiments, the first factor may be $C_{ave1}/C_{ave2}$ (i.e., the ratio of the average of the correction amounts for the pixels in the first region 110 to the average of the correction amounts for the pixels in the second region 120 before the modifying).

In other embodiments, the calibration software 600 may determine the first factor based on the ratio between the pixel density of the first region 110 and the pixel density of the second region 120. In embodiments where the pixel density of the second region 120 is lower than the pixel density of the first region 110, the first factor may be less than one. In one implementation, the first factor may be 1/N, where N is a number larger than one. In some implementations, the calibration software 600 may determine the first factor based on a ratio of the second pixel density to the first pixel density such that the first factor decreases with a decrease in the ratio of the second pixel density to the first pixel density. In embodiments where the first demura data 504 and the second demura data 506 are processed in the form of a data stream, the calibration software 600 may identify the second demura data 506 based on the region definition information in generating the modified second demura data 508.

At step 406, the first demura data 504 and the modified second demura data 508 are compressed to generate the compressed demura data 502. Modifying (e.g., multiplying) the correction amounts of the second demura data 506 by the first factor at step 404 effectively reduces variations in the correction amounts to be compressed, improving the compression efficiency and/or compression quality in generating the compressed demura data 502 at step 406.

The calibration software 600 provides the compressed demura data 502 and factor information 510 indicative of the first factor (e.g., 1/N) to the display module 1000. The compressed demura data 502 and the factor information 510 may be stored in a memory disposed in the display module 1000. The memory used to store the compressed demura data 502 and the factor information 510 may be a non-volatile memory such as a flash memory, an electrically erasable programmable read-only memory (EEPROM) or a different type of non-volatile memory.

In actual use, the display driver 200 of the display module 1000 applies demura processing to image data using the compressed demura data 502 and the factor information 510. More specifically, at step 408, the display driver 200 decompresses the compressed demura data 502 to generate first decompressed demura data 512 for the first region 110 and second decompressed demura data 514 for the second region 120.

At step 410, the display driver 200 generates modified second decompressed demura data 516 by modifying the correction amounts of the second decompressed demura data 514 by a second factor determined based on the factor information 510. In one or more embodiments, the modifying is achieved by multiplying the correction amounts of the second decompressed demura data 514 by the second factor. The second factor may be the reciprocal of the first factor used in generating the modified second demura data 508 at step 404. In embodiments where the pixel density of the second region 120 is lower than the pixel density of the first region 110 and the first factor is accordingly determined as being less than one, the second factor may be more than one. In embodiments where the first factor is 1/N, the second factor may be N. In embodiments where the first decompressed demura data 512 and the second decompressed demura data 514 are processed in the form of a data stream, the region definition information may be stored in a storage of the display module 1000 and the display driver 200 may identify the second decompressed demura data 514 based on the region definition information in generating the modified second decompressed demura data 516.

At step 412, the display driver 200 performs demura processing using the first decompressed demura data 512 and the modified second decompressed demura data 516. The display driver 200 applies demura processing to image data for the first region 110 using the first decompressed demura data 512. The display driver 200 may correct the image data for the first region 110 in accordance with the correction amounts indicated by the first decompressed demura data 512. The display driver 200 further applies demura processing to image data for the second region 120 using the modified second decompressed demura data 516. The display driver 200 may correct the image data for the second region 120 in accordance with the correction amounts indicated by the modified second decompressed demura data 516.

Figure 5:
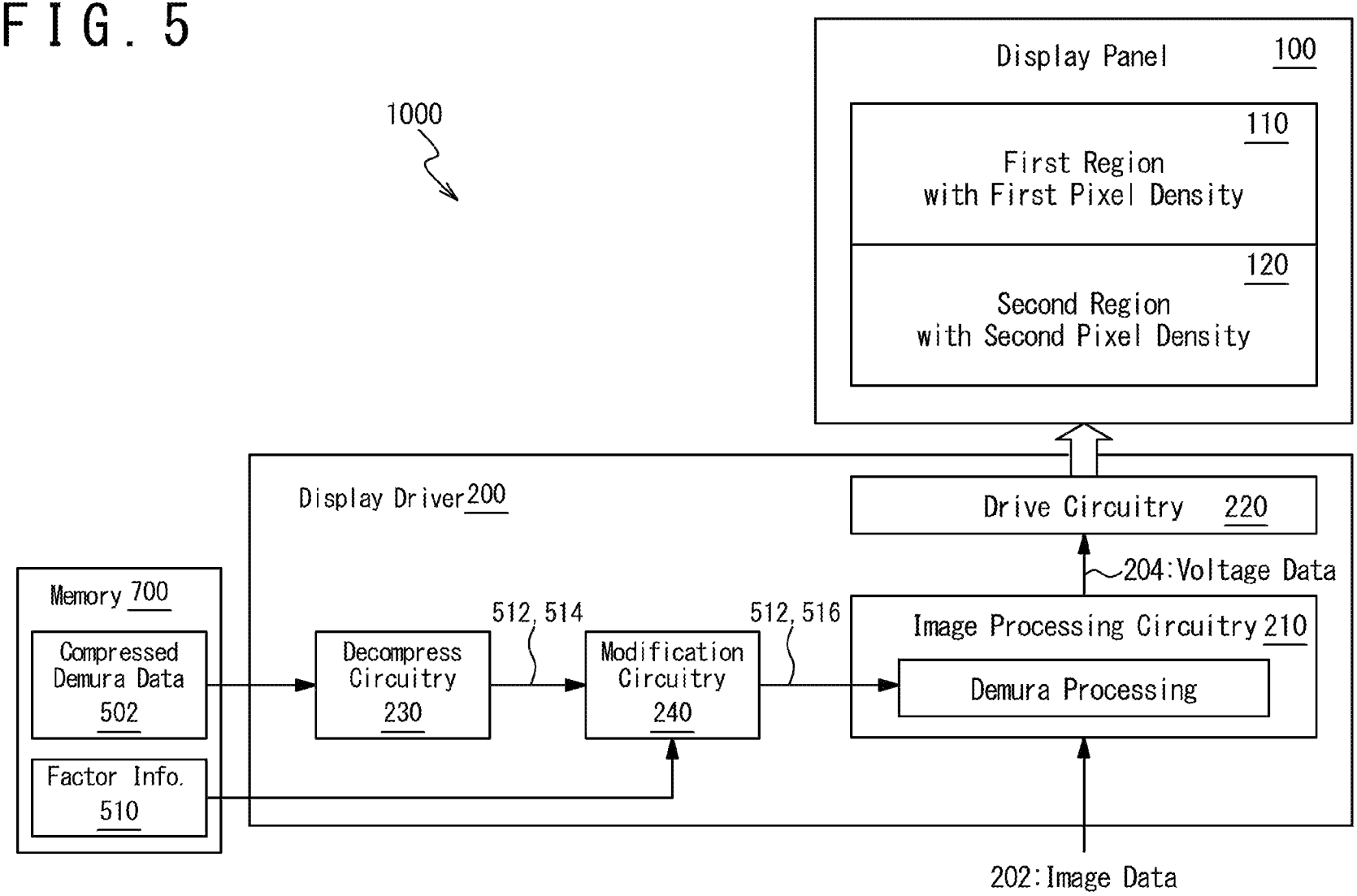
FIG. 5 illustrates an example configuration of a display module, according to one or more embodiments.

FIG. 5 illustrates an example detailed configuration of the display module 1000 adapted to the demura method illustrated in FIG. 4, according to one or more embodiments. In the illustrated embodiment, the display module 1000 additionally includes a memory 700 configured to store the compressed demura data 502 and the factor information 510. The memory 700 may be a non-volatile memory (NVM) such as a flash memory, an electrically erasable programmable read-only memory (EEPROM) or a different type of non-volatile memory. In other embodiments, the memory 700 may be integrated in the display driver 200.

In one or more embodiments, the display driver 200 includes image processing circuitry 210 and drive circuitry 220. The image processing circuitry 210 is configured to process image data 202 to generate voltage data 204. The image data 202 may include graylevels of the respective pixels in the display panel 100. The voltage data 204 may include voltage levels of drive voltages with which the respective pixels in the display panel 100 are to be updated. The processing applied to the image data 202 by the image processing circuitry 210 includes demura processing based on the compressed demura data 502 and the factor information 510. The drive circuitry 220 is configured to update the pixels in the display panel 100 based on the voltage data 204.

The display driver 200 further includes decompress circuitry 230 and modification circuitry 240. The decompress circuitry 230 is configured to decompress the compressed demura data 502 to generate the first decompressed demura data 512 for the first region 110 and the second decompressed demura data 514 for the second region 120. The modification circuitry 240 is configured to generate the modified second decompressed demura data 516 by multiplying the correction amounts of the second decompressed demura data 514 by the second factor determined based on the factor information 510 as described in relation to FIG. 4. The image processing circuitry 210 is configured to apply demura processing to the image data 202 using the first decompressed demura data 512 and the modified second decompressed demura data 516.

Figure 6:
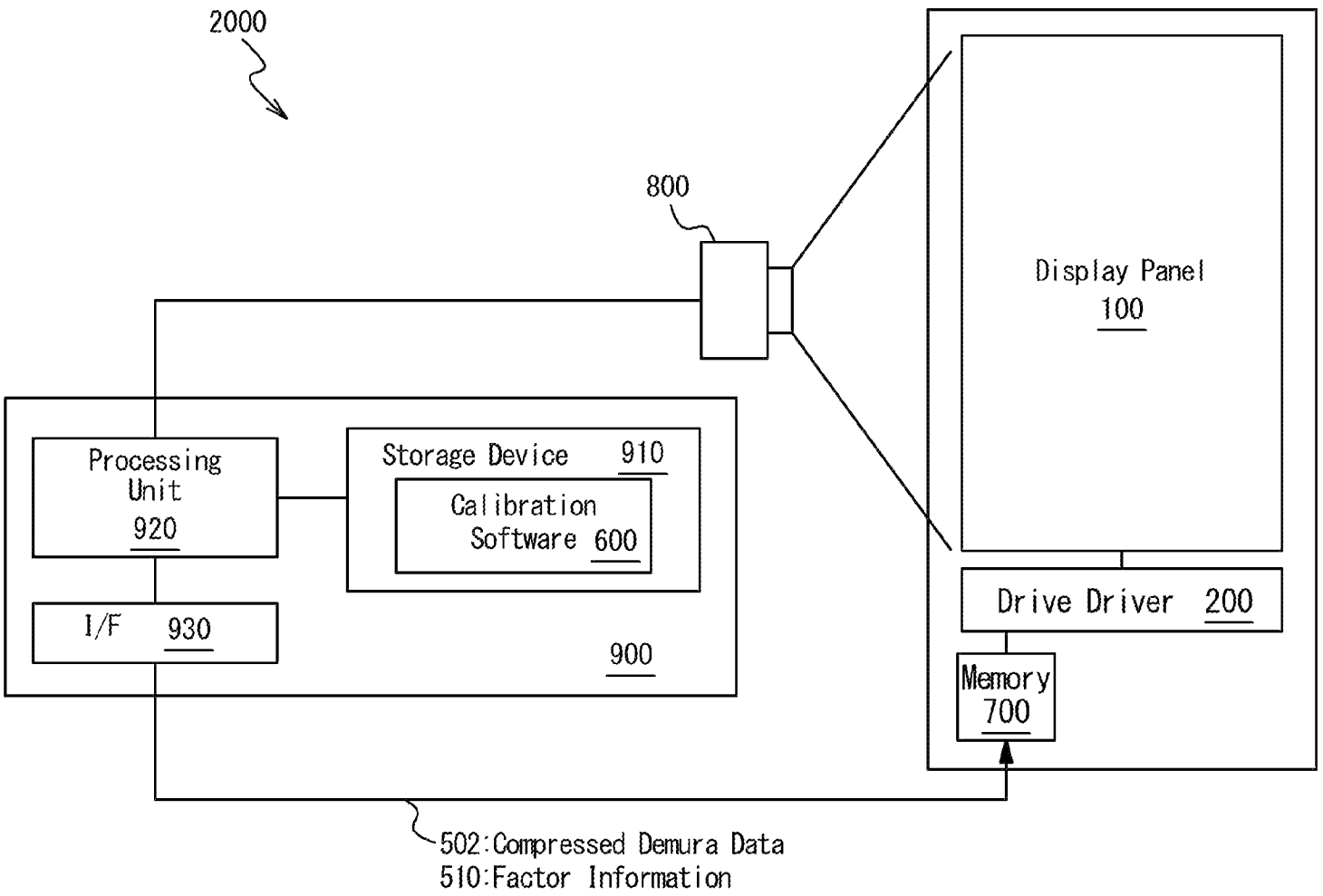
FIG. 6 illustrates an example configuration of a calibration device, according to one or more embodiments.

FIG. 6 illustrates an example configuration of a calibration device 2000 adapted to the demura method described in relation to FIG. 4, according to one or more embodiments. The calibration device 2000 is configured to generate the compressed demura data 502 and the factor information 510. In the illustrated embodiment, the calibration device 2000 includes an imaging device 800 and a computer 900. The imaging device 800 is configured to measure luminance values of the pixels in the display panel 100 for one or more test images. The test images may include one or more all-white images with different graylevels and/or one or more single-colored (e.g., all-red, all-green, and all-blue) images with different graylevels.

The computer 900 includes a storage device 910, a processing unit 920, and interface circuitry 930. The storage device 910 is configured to store the calibration software 600 while the processing unit 920 is configured to execute the calibration software 600. The calibration software 600 causes the processing unit 920 to generate the compressed demura data 502 and the factor information 510 as described in relation to FIG. 4. The calibration software 600 may further cause the processing unit 920 to generate the mura information of the display panel 100 based on the measured luminance values of the pixels in the display panel 100 acquired by the imaging device 800. The interface circuitry 930 is configured to provide the compressed demura data 502 and the factor information 510 to the memory 700 of the display module 1000.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A method, comprising, generating first demura data comprising first correction amounts for pixels in a first region of a display panel, the first region having a first pixel density;

generating second demura data comprising second correction amounts for pixels in a second region of the display panel, the second region having a second pixel density different from the first pixel density;

generating modified second demura data by modifying the second correction amounts of the second demura data by a first factor, wherein the first factor is based on a ratio between an average of the first correction amounts for the pixels in the first region and an average of the second correction amounts for the pixels in the second region;

compressing the first demura data and the modified second demura data to generate compressed demura data; and providing the compressed demura data and factor information indicative of the first factor to a display driver.

2. The method of claim 1, wherein data value variations in first entire demura data consisting of the first demura data and the modified second demura data are smaller than data value variations in second entire demura data consisting of the first demura data and the second demura data before the modifying.

3. The method of claim 1, wherein the first factor is based on a ratio between the first pixel density and the second pixel density.

4. The method of claim 1, wherein modifying the second correction amounts by the first factor comprises multiplying the second correction amounts by the first factor, wherein the second pixel density is lower than the first pixel density, and wherein the first factor is less than one.

5. The method of claim 1, further comprising:

operating at least one of the pixels in the first region to emit light with a first luminance for a given graylevel, and operating at least one of the pixels in the second region to emit light with a second luminance for the given graylevel, the second luminance being different from the first luminance.

6. The method of claim 1, wherein the second region comprises an under display camera (UDC) region under which a camera is disposed.

7. A method comprising:

generating first demura data comprising first correction amounts for pixels in a first region of a display panel, the first region having a first pixel density;

generating second demura data comprising second correction amounts for pixels in a second region of the display panel, the second region having a second pixel density different from the first pixel density, generating modified second demura data by modifying the second correction amounts of the second demura data by a first factor;

compressing the first demura data and the modified second demura data to generate compressed demura data;

providing the compressed demura data and factor information indicative of the first factor to a display driver;

decompressing the compressed demura data to generate first decompressed demura data for the first region and second decompressed demura data for the second region, the second decompressed demura data comprises third correction amounts for the pixels in the second region;

generating modified second decompressed demura data by modifying the third correction amounts of the second decompressed demura data by a second factor determined based on the factor information; and performing demura processing using the first decompressed demura data and the modified second decompressed demura data.

8. The method of claim 7, wherein modifying the second correction amounts by the first factor comprises multiplying the second correction amounts of the second demura data by the first factor, and wherein modifying the third correction amounts of the second decompressed demura data by the second factor comprises multiplying the third correction amounts of the second decompressed demura data by the second factor.

9. The method of claim 8, wherein the second factor is a reciprocal of the first factor.

10. The method of claim 8, wherein the second pixel density is lower than the first pixel density, and wherein the second factor is more than one.

11. A calibration device, comprising:

a processing unit configured to:

generate first demura data comprising first correction amounts for pixels in a first region of a display panel, the first region having a first pixel density;

generate second demura data comprising second correction amounts for pixels in a second region of the display panel, the second region having a second pixel density different from the first pixel density, generate modified second demura data by modifying the second correction amounts by a first factor, wherein the first factor is based on a ratio between an average of the first correction amounts for the pixels in the first region and an average of the second correction amounts for the pixels in the second region;

compress the first demura data and the modified second demura data to generate compressed demura data; and interface circuitry configured to provide the compressed demura data and factor information indicative of the first factor to a display driver.

12. The calibration device of claim 11, wherein data value variations in first entire demura data consisting of the first demura data and the modified second demura data are smaller than data value variations in second entire demura data consisting of the first demura data and the second demura data before the modifying.

13. The calibration device of claim 11, wherein the first factor is based on a ratio between the first pixel density and the second pixel density.

14. The calibration device of claim 11, wherein modifying the second correction amounts by the first factor comprises multiplying the second correction amounts by the first factor.

15. A display driver, comprising:

decompression circuitry configured to decompress compressed demura data to generate first decompressed demura data for a first region of a display panel and second decompressed demura data for a second region of the display panel, the first region having a first pixel density, the second region having a second pixel density different from the first pixel density, wherein the compressed demura data is generated by compressing modified second demura data, the modified second demura data generated using a ratio between an average of first correction amounts for the pixels in the first region and an average of second correction amounts for the pixels in the second region;

modification circuitry configured to generate modified second decompressed demura data by modifying correction amounts of the second decompressed demura data by a second factor; and image processing circuitry configured to perform demura processing using the first decompressed demura data and the modified second decompressed demura data.

16. The display driver of claim 15, wherein the second factor is based on a ratio between the first pixel density and the second pixel density.

17. The display driver of claim 15, wherein modifying the correction amounts of the second decompressed demura data by the second factor comprises multiplying the correction amounts of the second decompressed demura data by the second factor.

18. The display driver of claim 17, wherein the second pixel density is lower than the first pixel density, and wherein the second factor is more than one.

* * * * *